United States Patent [19]

Martin et al.

[11] 4,189,974

[45] Feb. 26, 1980

[54] GUITAR NECK ASSEMBLY

[76] Inventors: James O. Martin, 249 Ridgewood Rd., Goodlettsville, Tenn. 37072; Rex D. Fathergill, Rte. 6, Frankfort, Ky. 40601; David L. Krimm, 286 Tangley Way, Lexington, Ky. 40503

[21] Appl. No.: 944,927

[22] Filed: Sep. 22, 1978

[51] Int. Cl.[2] ..... G10D 3/06

[52] U.S. Cl. ..... 84/293; 84/314 R

[58] Field of Search ..... 84/173, 267, 293, 314 R

[56] References Cited

U.S. PATENT DOCUMENTS

| | | | |
|---|---|---|---|
| 310,906 | 1/1885 | Miller | 84/293 |
| 549,966 | 11/1895 | Hutchins | 84/293 X |
| 3,469,489 | 9/1969 | Barth | 84/314 |
| 3,894,468 | 7/1975 | Dunlap | 84/314 |
| 4,145,948 | 3/1979 | Turner | 84/293 |

*Primary Examiner*—Lawrence R. Franklin

*Attorney, Agent, or Firm*—Harrington A. Lackey

[57] ABSTRACT

A guitar assembly including an elongated, channel-shaped, open-top, neck body upon which are mounted a plurality of longitudinally spaced, transversely disposed, free-spanning fret bars.

9 Claims, 11 Drawing Figures

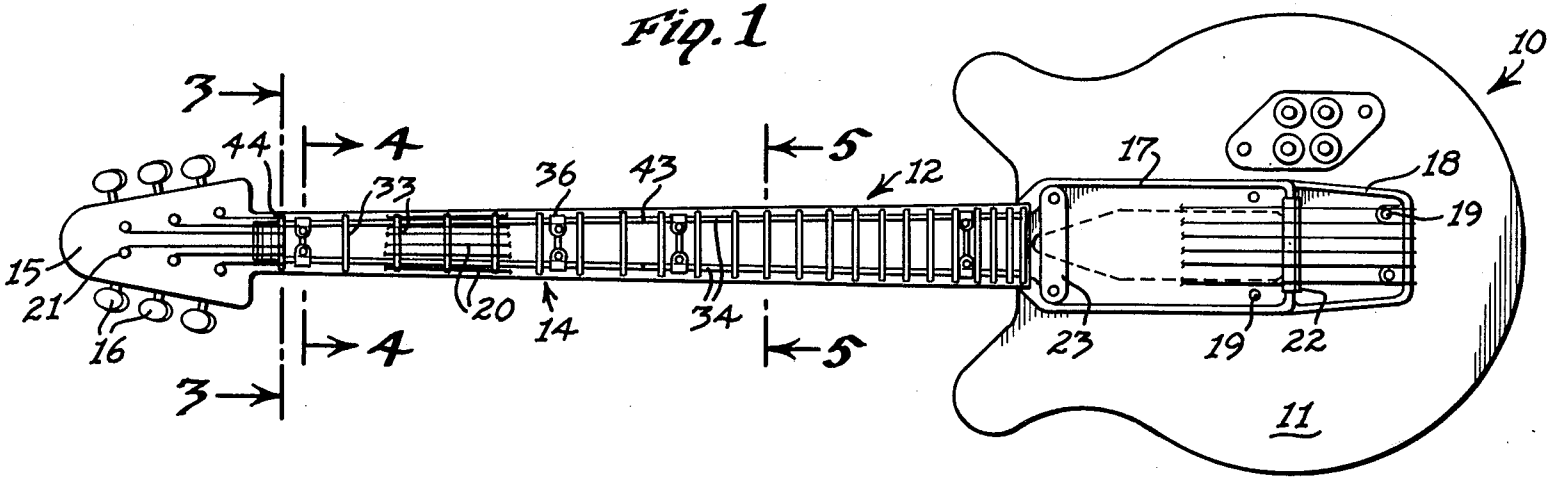
Fig. 1
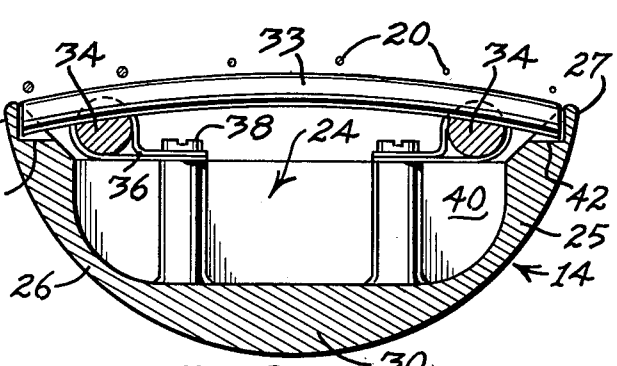
Fig. 2
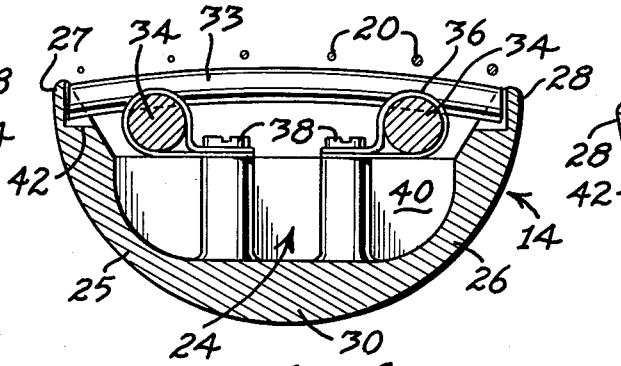
Fig. 4
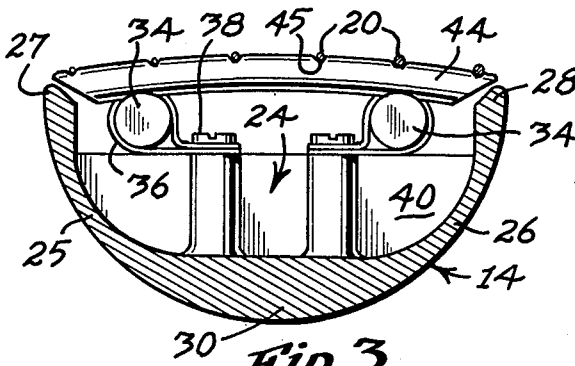
Fig. 3
Fig. 5

GUITAR NECK ASSEMBLY

BACKGROUND OF THE INVENTION

This invention relates to stringed musical instruments, and more particularly to a guitar neck.

Conventionally, the necks of stringed musical instruments are of solid material, or at least have an elongated flat surface upon which the longitudinally spaced transverse frets are mounted to form a fingerboard against which the strings are manipulated or pressed by the musician.

The only stringed musical instruments having a hollow neck, known to the applicant are disclosed in the two U.S. McBride Pat. Nos. 2,368,256 and 2,368,257, both issued Jan. 30, 1945. However, neither of the hollow necks disclosed in the McBride patents support the fret construction contemplated by this invention.

SUMMARY OF THE INVENTION

It is therefore an object of this invention to provide in a stringed musical instrument, and more particularly in a guitar, an elongated channel-shaped, open-top, hollow neck body, across which span longitudinally spaced transverse frets, or fret bars, constructed in accordance with this invention.

The channel-shaped, open-top neck body may be constructed in various ways, such as by die-casting, or by stamping and forming from sheet metal. The material from which the neck body is made is preferably metal, as opposed to wood, in order to give the guitar a special sound.

Each fret or fret bar, is supported only at its ends by the opposed under portions of the channel-shaped neck body, so that the fret bars have their conventional longitudinal spacing. The support for any fret bar between its opposite ends upon the neck body is minimal to nonexistent.

Where the neck body is die-cast, the frets may be cylindrical metal fret bars attached at their opposite end portions to the upper edge portions of the hollow neck body in any desired manner. If the neck body is stamped from sheet metal, the frets may be round-formed as an integral part of the sheet metal.

There are several advantages to this particular construction of supporting the frets only at their end portions upon the upper edge portions of a hollow-channel shaped neck body.

First of all, a different sound is obtained.

Secondly, not only is the fingerboard removed, but much of the mass of the neck is removed to reduce the overall weight of the guitar, and specifically the neck.

Thirdly, most of the surfaces of the frets are free of support to permit the musician more freedom in the application of finger pressure upon the strings against the surfaces of the frets. The strings may not only be pressed downward upon the fret perpendicular to the axis of the neck, but may also be pressed at angles to the perpendicular against the side surfaces of the frets, to provide easier "note bending."

There is also a substantial reduction of parts required for making the neck body and the frets, thus simplifying the manufacture and maintenance of the guitar.

The maximum unsupported areas and the spacing between the frets develops better musicianship by penalizing excess finger pressure. In other words, the control of the sound of the guitar by engagement of the strings against the fret is more responsive to finger pressure.

BRIEF DESCRIPTION OF THE DRAWINGS

FIG. 1 is a top plan view of a guitar incorporating one form of neck body made in accordance with this invention;

FIG. 2 is a side elevation of the guitar disclosed in FIG. 1;

FIG. 3 is an enlarged section taken along the line 3—3 of FIG. 1;

FIG. 4 is an enlarged section taken along the line 4—4 of FIG. 1;

FIG. 5 is an enlarged section taken along the line 5—5 of FIG. 1;

DESCRIPTION OF THE PREFERRED EMBODIMENTS

Figure 7:
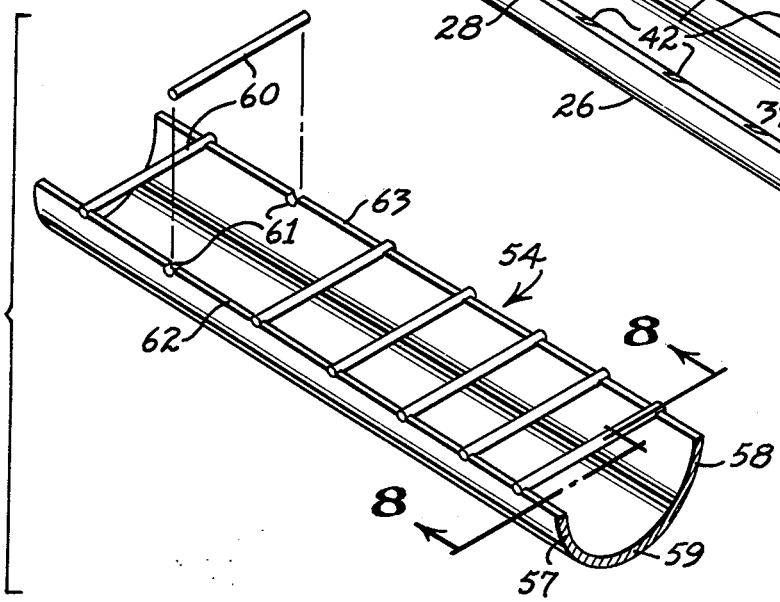
FIG. 7 is a fragmentary, top perspective view, with one of the fret bars removed, of a modified neck body assembly.

Referring now to the drawings in more detail, FIGS. 1 and 2 disclose an electric guitar 10 including a solid wood body 11 upon which is mounted one form of the guitar assembly 12 made in accordance with this invention. The particular guitar neck assembly 12 disclosed in FIGS. 1 and 2 includes the hollow, channel-shaped neck body 14 made in accordance with this invention, the head 15 supporting the tuners 16, the pickup mount 17 and the tailpiece 18, all integrally formed from a single die-casting. It will be understood that the single die-casting for all of these parts is not an essential part of the construction of the neck body per se.

The pickup mount 17 and tailpiece 18 are fixed to the solid guitar body 11 by means such as screws 19. The guitar strings 20 are strung between the tailpiece 18 and the tuning pegs 21 across the bridge 22, to extend substantially longitudinally over the neck body 14.

The pickup mount 17 supports an electrical pickup 23, as disclosed in FIG. 1.

As best disclosed in FIGS. 3, 4, 5 and 6, the neck body 14 is channel-shaped to form a hollow open space 24 between the opposite walls 25 and 26 terminating in upper edge portions 27 and 28.

The shape of the outer surface of the neck body 14 is substantially semi-circular. Moreover, the open space 24 between the side walls 25 and 26 occupies a substantially greater part of the cross-sectional area of the neck body 14 than the solid side walls 25 and 26 and the bottom wall 30. It will be noted that the bottom wall 30 is slightly thicker than the side walls 25 and 26 for greater strength.

Moreover, because of the channel-shape of the neck body 14, there is a greater strength-to-weight ratio than for a conventional solid-neck body and fingerboard. The channel-shaped body 14 provides greater resistance against longitudianl bending in either the perpendicular or lateral plane of the neck body 14, and against contortion or twisting movement.

The fret assembly 32, disclosed in FIGS. 1–6, includes a plurality of elongated fret bars 33 of substantially circular cross-section, longitudinaly spaced and spanning the upper edge portions of the neck body 14.

Figure 6:
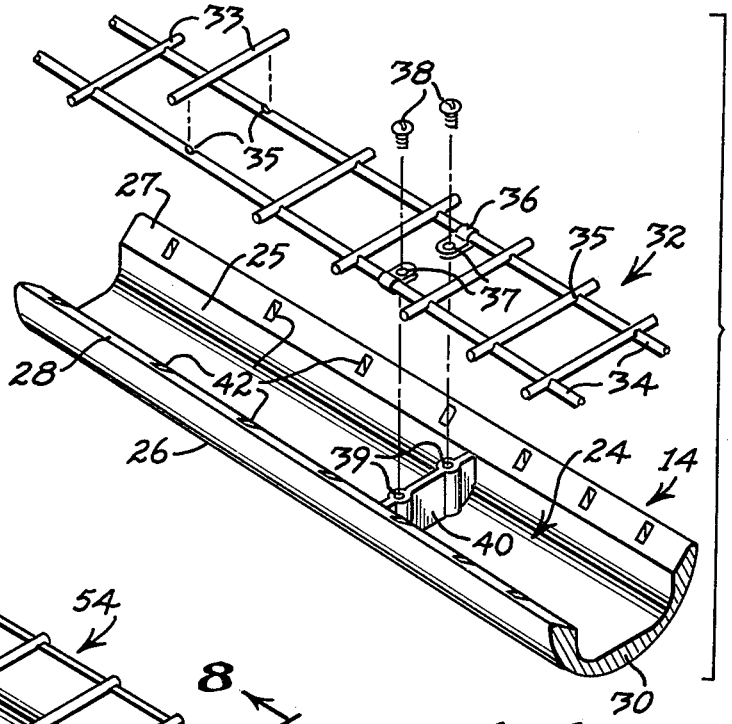
FIG. 6 is a fragmentary, exploded, top perspective view of a portion of the neck body disclosed in FIG. 1.

In the particular embodiment of the fret assembly 32, the fret bars 33 are first mounted upon longitudinal fret support bars 34, by being received in snugly or tightly fitted transversely aligned grooves 35 (FIG. 6). The spacing between the longitudinal fret support bars 34 is small enough that both fret support bars 34 will fit within the hollow space 24. The fret support bars 34 are mounted at the proper height to support the fret bars 33 across the upper portion of the neck body 14, as best disclosed in FIGS. 3, 4 and 5.

Fitted around the fret support bars 34 at longitudinally spaced intervals are mounting clips 36 having opposed ears with vertically aligned holes 37 for receiving mounting screws 38. After the mounting screws 38 are inserted through the vertically aligned holes 37 they are screwed into vertically disposed, internally threaded holes 39 in transverse mounting brackets 40 fixed transversely across the lower inside portion of the channel-shaped neck body 14. The brackets 40 also span the entire transverse distance between the opposing neck walls 25 and 26, and, in addition to their function as supports for the fret assembly 32, provide stiffening or reinforcing for the neck body 14.

As best disclosed in FIGS. 4, 5 and 6, the upper surfaces of the upper portions 27 and 28 may include opposed recesses 42 for receiving the opposite ends of the fret bars 33.

The fret assembly 32 may be formed in longitudinal sections, as indicated by the break lines 43 in FIG. 1. There may be two or more sections in order to facilitate assembly, but more importantly to permit replacement of only one section, should such section become worn or defective, necessitating replacing only that section instead of the entire length of the fret assembly.

Disposed at the upper end of the neck body 14 is a transverse member or nut 44 having notches 45 for receiving and bending the strings 20 so that they may be secured to the pegs 21. Thus, the strings 20 span the entire length of the guitar between the nut 44 and the bridge 22, in a conventional manner.

Figure 8:
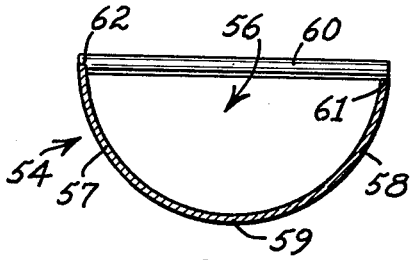
FIG. 8 is an enlarged section taken along the line 8—8 of FIG. 7.

The modified channel-shaped neck body 54 disclosed in FIGS. 7 and 8 is formed in a substantially semi-circular cross-section with a uniform wall thickness. In this simplified construction of the neck body 54, the hollow open space 56 between the side walls 57 and 58 and the bottom wall 59 forms a substantially greater part of the cross-section of the neck body 54 than the hollow space 24 does in its neck body 14.

The transverse fret bars 60 are supported at their end portions in correspondingly tight-fitting grooves 61 formed in the upper edges 62 and 63 of the wall portions 57 and 58.

In this simplified construction of the neck body 54, the fret bars 60 are supported directly by the upper edge portions 62 and 63 of the neck body 54 without any additional support, thus substantially simplifying the construction of the neck body 54.

The end portions of the fret bars 60 may be press-fitted, welded or otherwise secured in their corresponding grooves 61.

Figure 10:
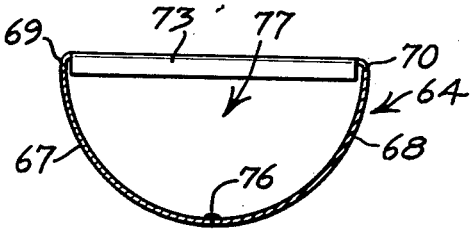
FIG. 10 is a section taken along the line 10—10 of FIG. 9.
Figure 9:
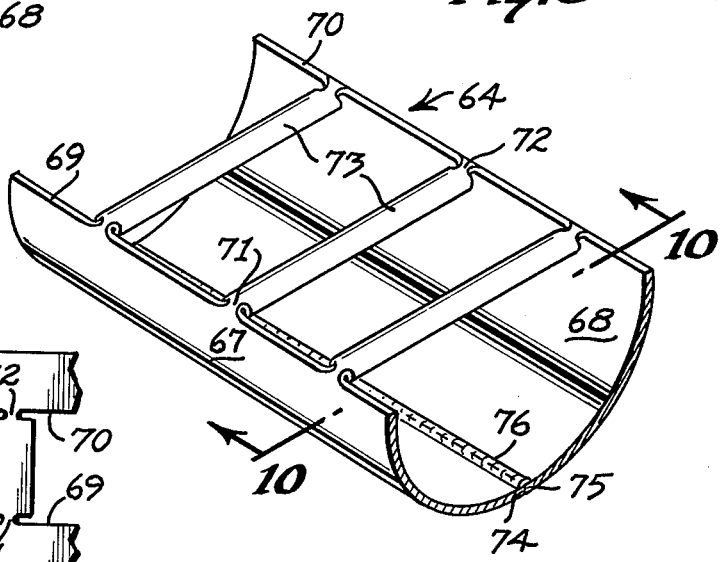
FIG. 9 is a fragmentary, top perspective view of a second modified neck body assembly made in accordance with this invention.
Figure 11:
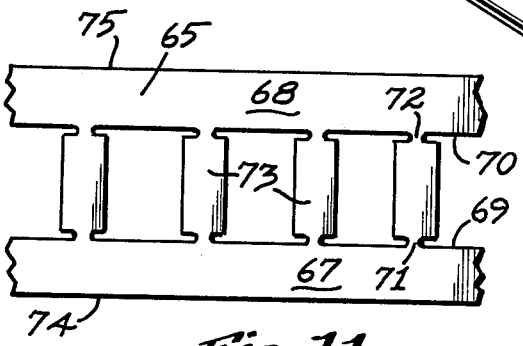
FIG. 11 is a fragmentary top plan view of a stamped blank of sheet material from which the guitar neck disclosed in FIGS. 9 and 10 is constructed.

The modified neck body 64 disclosed in FIGS. 9–11 is formed from a single piece of sheet metal. The sheet metal is stamped or punched to form the blank 65 having the side wall portions 67 and 68 defined by edges or edge portions 69 and 70. Spanning and integrally connected to the upper edges 69 and 70 by the integral connecting pieces 71 and 72 are the fret portions 73.

After stamping the blank 65, the fret portions 73 are shaped to have upper convex surfaces as disclosed in FIGS. 9 and 10. The side walls 67 and 68 are shaped to curve downwardly until their bottom edges 74 and 75 abut each other for subsequent joining by an elongated welded seam 76.

Again, the neck body 64 includes a simplified construction in which the frets or fret portions 73 are supported only at their end portions by the integral connecting pieces 71 and 72 with the walls of the hollow body 64.

In all modifications of the neck bodies 14, 54, and 64, construction of the bodies is channel-shaped, in which the maximum area of the cross-section of each body is occupied by a hollow space. Moreover, all of the neck bodies 14, 54, and 64 are preferably made of metal to achieve, in combination with the channel-shape of the body, superior strength and an increased strength-to-weight ratio.

Each of the neck bodies 14, 54 and 64 has an open top and defines a substantially hollow space for providing a different type of sound to the guitar upon which the respective bodies are assembled.

But most importantly, the respective frets or fret bars 33, 60 and 73 have minimal points of support and are substantially unsupported throughout the middle portion of each fret or fret bar. Such unobstructed fret bar support permits a greater versatility for manipulating the guitar strings 20 against the respective frets, permitting a greater range of note formation. Basically, both top and side pressure may be exerted by the fingers of the musical performer against the strings and the frets or fret bars.

The free spanning frets and fret bars 33, 60 and 73 eliminate the burying of conventional frets in a fingerboard where only a small amount of the fret surface can be engaged by finger pressure against the corresponding strings. Moreover, the guitar strings 20 engage solely the respective frets or fret bars 33, 60 and 73, as opposed to also engaging the fingerboard by the finger pressure of the musician. By eliminating the fingerboard, there is more room down between each pair of adjacent frets for manipulation of the fingers of the musical performer.

The construction of the neck bodies 14 and 54, not only provides fewer parts to facilitate manufacturing, but also permits relatively unskilled maintenance of the neck body and replacement of the fret bars when they become worn.

What is claimed is:

1. A neck assembly for a stringed musical instrument comprising:

(a) an elongated, channel-shaped, open-top, neck body, having elongated first and second upper edge portions, (b) a plurality of elongated fret members having first and second end portions, (c) means securing said fret members to said neck body to substantially span the open top of said neck body, so that said fret members are disposed transversely and spaced longitudinally of said neck body and beneath the strings of a stringed musical instrument of which said neck body forms a part.

2. The invention according to claim 1 in which said securing means comprise first means for securing said first end portions at longitudinally spaced apart positions on said first upper edge portion and second means for securing said second end portions at longitudinally spaced apart positions on said second upper edge portion, so that said fret members are substantially parallel.

3. The invention according to claim 2 in which said first and second securing means comprise longitudinally spaced notches in said respective upper edge portions for receiving the respective ends of said fret members.

4. The invention according to claim 2 in which said neck body and fret members are formed from an integral one-piece sheet member, said first and second securing means comprising integral connecting pieces connecting the opposite ends of said fret members to the opposite upper edge portions of said neck body.

5. The invention according to calim 4 in which the forms of said fret members and hollow body are stamped from said one-piece sheet material so that said neck body is formed of two identical half sections having opposed abutting bottom edges, longitudinal seam means securing said bottom edges.

6. The invention according to claim 5 in which said elongated fret members have upper convex curved surfaces in cross-section.

7. The invention according to claim 1 in which said fret members are uniform, cylindrical fret bars.

8. The invention according to claim 1 in which said securing means comprise a pair of elongated support rods on which said fret members are mounted transversely parallel to each other and longitudinally spaced, bracket means within said channel-shaped neck body for supporting said longitudinal support rods, and means for detachably securing said longitudinal rods to said bracket members.

9. The invention according to claim 8 in which said elongated support rods are formed in sectional lengths, each of which pair of sectional lengths are independently detachably secured to said bracket members.

* * * * *